US005858205A

United States Patent [19]

Huebner

[11] Patent Number: 5,858,205

[45] Date of Patent: Jan. 12, 1999

[54] MULTIZONE CATALYTIC REFORMING PROCESS

[75] Inventor: Aronson L. Huebner, Palatine, Ill.

[73] Assignee: UOP LLC, Des Plaines, Ill.

[21] Appl. No.: 855,232

[22] Filed: May 13, 1997

[51] Int. Cl.[6] ..... C10G 35/06

[52] U.S. Cl. ..... 208/65; 208/137; 208/138

[58] Field of Search ..... 208/65

[56] References Cited

U.S. PATENT DOCUMENTS

| | | | |
|---|---|---|---|
| 3,578,584 | 5/1971 | Hayes | 208/139 |
| 4,645,586 | 2/1987 | Buss | 208/65 |
| 4,663,020 | 5/1987 | Fleming | 208/65 |
| 4,722,780 | 2/1988 | Franck et al. | 208/65 |
| 4,737,262 | 4/1988 | Franck et al. | 208/65 |
| 4,764,267 | 8/1988 | Chen et al. | 208/65 |
| 4,929,332 | 5/1990 | Moser et al. | 208/65 |
| 4,929,333 | 5/1990 | Moser et al. | 208/65 |
| 4,985,132 | 1/1991 | Moser et al. | 208/65 |

*Primary Examiner*—Helane Myers
*Attorney, Agent, or Firm*—Thomas K. McBride; John F. Spears, Jr.; Richard E. Conser

[57] ABSTRACT

A hydrocarbon feedstock is catalytically reformed in a process which comprises at least three catalyst zones. The feedstock contacts a catalyst comprising platinum, a halogen, and a metal promoter on a solid catalyst support in a first catalyst zone. Effluent from the first catalyst zone contacts a catalyst comprising platinum, germanium and halogen on a solid catalyst support in an intermediate catalyst zone to obtain an intermediate effluent, which contacts a catalyst having the essential absence of germanium and comprising platinum, halogen and a metal promoter on a solid catalyst support in a terminal catalyst zone to obtain a reformate.

18 Claims, No Drawings

MULTIZONE CATALYTIC REFORMING PROCESS

BACKGROUND OF THE INVENTION

Field of the Invention

This invention relates to an improved process for the conversion of hydrocarbons, and more specifically for the catalytic reforming of gasoline-range hydrocarbons.

General Background

The catalytic reforming of hydrocarbon feedstocks in the gasoline range is an important commercial process, practiced in nearly every significant petroleum refinery in the world to produce aromatic intermediates for the petrochemical industry or gasoline components with high resistance to engine knock. The widespread removal of lead antiknock additive from motor fuels, subsequent gasoline reformulation and the rising demands of high-performance internal-combustion engines are increasing the need for gasoline "octane", or knock resistance of gasoline blending components. Furthermore, the demand for aromatic hydrocarbons for chemical syntheses continues to increase throughout the industrial world. The catalytic reforming unit must operate at higher severities in order to meet these increased octane and aromatics needs. This trend creates a need for more effective reforming catalysts and catalyst combinations.

The multi-functional catalyst composite employed in catalytic reforming contains a metallic hydrogenation-dehydrogenation component on a porous, inorganic oxide support which provides acid sites for cracking and isomerization. Catalyst composites comprising platinum on highly purified alumina are particularly well known in the art. Those of ordinary skill in the art are also aware of metallic modifiers, such as rhenium, iridium, tin, and germanium which improve product yields or catalyst life in platinum-catalyst reforming operations.

The composition of the catalyst, feedstock properties, and selected operating conditions affect the relative importance and sequence of the principal reactions: dehydrogenation of naphthenes to aromatics, dehydrocyclization of paraffins to aromatics, isomerization of paraffins and naphthenes, hydrocracking of paraffins to light hydrocarbons, and formation of coke which is deposited on the catalyst. Naphthene dehydrogenation takes place principally in the first catalyst zones, while hydrocracking is largely accomplished in later catalyst zones. High yields of desired gasoline-range products are favored by the dehydrogenation, dehydrocyclization, and isomerization reactions.

The performance of catalysts employed in the catalytic reforming of naphtha range hydrocarbons is measured principally by three parameters:

(1) Activity is a measure of the ability of the catalyst to convert hydrocarbon reactants to products at a designated severity level, with severity level representing a combination of reaction conditions: temperature, pressure, contact time, and hydrogen partial pressure. Activity typically is designated as the octane number of the pentanes and heavier ("$C_5^+$") product stream from a given feedstock at a given severity level, or conversely as the temperature required to achieve a given octane number.

(2) Selectivity refers to the yield of petrochemical aromatics or $C_5^+$ product from a given feedstock at a particular activity level.

(3) Stability refers to the rate of change of activity or selectivity per unit of time or of feedstock processed. Activity stability generally is measured as the rate of change of operating temperature per unit of time or of feedstock to achieve a given $C_5^+$ product octane, with a lower rate of temperature change corresponding to better activity stability, since catalytic reforming units typically operate at relatively constant product octane. Selectivity stability is measured as the rate of decrease of $C_5^+$ product or aromatics yield per unit of time or of feedstock.

Higher catalyst activity is required to meet the need for high octane gasoline components at reasonable operating conditions, and improved catalyst selectivity becomes more important as higher operating severities reduce the yield of desired product.

Higher operating severities also accelerate the deactivation of the catalyst. The principal cause of deactivation of a dual-function catalyst in a catalytic reforming operation is the aforementioned formation of coke on the surface of the catalyst. Alternative approaches to reactivation of the catalyst are well known to those skilled in the art. Regeneration of the catalyst may be carried out during a periodic shutdown of the unit, i.e., a "semiregenerative" operation, or by isolation and regeneration of individual reactors, i.e., a "swing-reactor" system. In a "continuous" operation, catalyst is withdrawn by means of a slowly moving bed, regenerated, reactivated, and returned to the reactors. The "hybrid" system is a combination of regeneration techniques, in which a reactor associated with continuous catalyst regeneration is added to an existing fixed-bed system. The reactants may contact the catalyst in individual reactors in either upflow, downflow, or radial-flow fashion, with the radial-flow mode being preferred.

The problem facing workers in this area of the art, therefore, is to develop catalyst systems with improved activity, selectivity, and stability for a variety of feedstocks, product requirements, and reactor systems. This problem has become more challenging due to the aforementioned increase in required catalytic reforming severity. Multi-catalyst-zone systems, in which different catalyst composites are employed in the sequential zones of the reactor system, may comprise one solution to the problem. The activity, selectivity, and stability characteristics of individual catalyst composites are complementary to the specific reactions occurring in the different zones of the multi-zone system.

Two-catalyst systems have been disclosed in the reforming art. U.S. Pat. Nos. 4,929,332 and '333 disclose a first catalyst comprising germanium and at least one platinum group metal on a solid catalyst support. The second catalyst comprises platinum and another promoter which preferably is rhenium. The first catalyst of '332 consists essentially of Pt-Ge on a support. The '333 patent differs in that the second catalyst has the essential absence of Ge. Related U.S. Pat. No. 4,985,132 introduces a terminal catalyst zone comprising a moving-bed system with continuous catalyst regeneration.

Reforming catalysts containing germanium are known in the prior art. For example, U.S. Pat. No. 3,578,584 describes a catalyst comprising germanium, a platinum group metal, and a halogen on a porous carrier material particularly useful in the reforming of a gasoline fraction.

The benefits of three stages of catalyst with a germanium-containing catalyst in the middle zone have not been described in the prior art. Surprising yield improvements from the use of a first-zone catalyst containing germanium are notably applicable in semi-regenerative and cyclic catalytic reforming units, where germanium-containing catalysts are commercially proven.

SUMMARY OF THE INVENTION

It is an object of the present invention to provide an improved process for the catalytic reforming of hydrocarbons. A corollary objective of the invention is to increase the yield of petrochemical aromatics or gasoline product from the reforming of gasoline-range hydrocarbons.

This invention is based on the discovery that a multi-catalyst-zone reforming process employing an first catalytic composite comprising supported platinum and a metal promoter other than germanium, an intermediate catalytic composite comprising supported platinum and germanium and a terminal catalytic composite comprising supported platinum and a metal promoter other than germanium demonstrates surprising yield improvements over a single-catalyst system.

One embodiment of the present invention is directed toward the catalytic reforming of a hydrocarbon feedstock by contacting the feedstock sequentially with a catalyst system which comprises a first catalytic composite comprising platinum, a metal promoter, a refractory inorganic oxide and a halogen in an first catalyst zone; an intermediate catalytic composite comprising platinum, germanium, a refractory inorganic oxide and a halogen in an intermediate catalyst zone; and a terminal catalytic composite comprising platinum, a metal promoter, a refractory inorganic oxide and a halogen in a terminal catalyst zone. Hydrogen optimally is combined with the feedstock to the catalyst system. Preferably the metal promoter is selected from one or more of rhenium, cobalt, nickel, indium, tin, ruthenium, iridium and mixtures thereof. Optionally, the metal promoter of the first and terminal catalytic composites is selected from the group consisting of rhenium, indium and tin. Preferably, the intermediate catalytic composite consists essentially of platinum, germanium, refractory inorganic oxide and halogen components.

In a preferred embodiment, the refractory inorganic oxide of the first, intermediate and terminal catalytic composites comprises alumina The halogen of the first, intermediate and terminal catalytic composites preferably comprises a chlorine component.

In an alternative embodiment, the terminal catalyst zone comprises a moving-bed system with continuous catalyst regeneration.

These as well as other objects and embodiments will become apparent upon reading of the detailed description of the invention.

DETAILED DESCRIPTION OF THE INVENTION

A broad embodiment of the present invention is a catalytic reforming process wherein a hydrocarbon feedstock contacts a catalyst system which comprises sequentially a first catalytic composite comprising a platinum-group metal, a metal promoter, a refractory inorganic oxide and a halogen in a first catalyst zone; an intermediate catalytic composite comprising a platinum-group metal, germanium, a refractory inorganic oxide and a halogen in an intermediate catalyst zone; and a terminal catalytic composite comprising a platinum-group metal, a metal promoter, a refractory inorganic oxide and a halogen in a terminal catalyst zone.

The basic configuration of a catalytic reforming process is known in the art. The hydrocarbon feedstock and a hydrogen-rich gas are preheated and charged to a reforming zone containing generally two or more, and typically from two to five, reactors in series. Suitable heating means are provided between reactors to compensate for the net endothermic heat of reaction in each of the reactors.

The individual first, intermediate and terminal catalyst zones respectively containing the first, intermediate and terminal catalytic composites are typically each located in separate reactors, although it is possible that the catalyst zones could be separate beds in a single reactor. Each catalyst zone may be located in two or more reactors with suitable heating means provided between reactors as described hereinabove, for example with the first catalyst zone located in the first reactor and the terminal catalyst zone in three subsequent reactors. The segregated catalyst zones also may be separated by one or more reaction zones containing a catalyst composite having a different composition from either of the catalyst composites of the present invention.

Preferably the first catalytic composite comprises from about 10% to about 50%, the intermediate catalytic composite comprises from about 20% to about 60% and the terminal catalytic composite comprises from about 30% to about 70% of the total mass of catalytic composites in all of the catalyst zones.

The reactants may contact the catalyst in individual reactors in either upflow, downflow, or radial-flow fashion, with the radial-flow mode being preferred. The catalyst is contained in a fixed-bed system or a moving-bed system with associated continuous catalyst regeneration. The preferred embodiment of the current invention is a fixed-bed system. Alternative approaches to reactivation of the catalyst are well known to those skilled in the art:

- Semiregenerative: The entire unit is operated to maintain activity by gradually increasing temperature to maintain product octane number, finally shutting the unit down for catalyst regeneration and reactivation.
- Swing reactor: Individual reactors are individually isolated by manifolding arrangements as the contained catalyst becomes deactivated, and the catalyst in the isolated reactor is regenerated and reactivated while the other reactors remain on-stream.
- Continuous: Catalyst is continuously withdrawn from the reactors by means of a slowly moving bed, and the catalyst is regenerated and reactivated before being returned to the reactors. This system permits higher operating severity and maintains high catalyst activity by reactivating each catalyst particle over a period of a few days.
- Hybrid: Semiregenerative and continuous reactors are contained in the same unit. In this embodiment, the first and intermediate catalyst zones usually comprise fixed beds and the terminal catalyst zone is a moving-bed system with associated continuous catalyst regeneration. This system may be effected by adding a continuous reactor to an existing semiregenerative process unit to provide for higher severity operation with improved selectivity.

The appropriate mode depends on individual circumstances, e.g., the configuration of an existing unit in which the invention is to be used. For a new unit, the choice would be determined by such factors as severity, importance of yield and its relation to operating pressure, and desired on-stream efficiency.

Effluent from the reforming zone is passed through a cooling means to a separation zone, typically maintained at about 0° to 65° C., wherein a hydrogen-rich gas is separated from a liquid stream commonly called "unstabilized reformate". The resultant hydrogen stream can then be recycled through suitable compressing means back to the reforming zone. The liquid phase from the separation zone is typically withdrawn and processed in a fractionating system in order to adjust the butane concentration, thereby controlling front end volatility of the resulting reformate.

The hydrocarbon feedstock that is charged to the present reforming process comprises naphthenes and paraffins that boil within the gasoline range. The preferred feedstocks are naphthas consisting principally of naphthenes and paraffins, although, in most cases, aromatics also will be present. This preferred class includes straight-run gasolines, natural gasolines, synthetic gasolines, and the like. As an alternative embodiment, it is frequently advantageous to derive the feedstock from thermally or catalytically cracked gasolines or partially reformed naphthas. Mixtures of straight-run and cracked gasoline-range naphthas can also be used to advantage. The gasoline-range naphtha feedstock may be a full-boiling gasoline having an initial boiling point of from about 40°–70° C. and an end boiling point within the range of from about 160°–220° C., or may be a selected fraction thereof which generally will be a higher-boiling fraction commonly referred to as a heavy naphtha—for example, a naphtha boiling in the range of 100°–200° C. In some cases, it is also advantageous to charge pure hydrocarbons or mixtures of hydrocarbons that have been recovered from extraction units—for example, raffinates from aromatics extraction or straight-chain paraffins.

It is a preferred practice to use the present invention in a substantially sulfur-free environment. Any control means known in the art may be used to treat the hydrocarbon feedstock which is to be charged to the reforming reaction zone. The feedstock may be subjected to catalytic processes, adsorption processes, or combinations thereof. It is preferred that the feedstock is treated by conventional catalytic pretreatment methods such as hydrorefining, hydrotreating, hydrodesulfurization, etc., to remove substantially all sulfurous, nitrogenous and water-yielding contaminants therefrom, and to saturate any olefins that may be contained therein. Thermally and catalytically cracked gasolines may require more severe operating conditions particularly to remove nitrogenous and olefinic contaminants in order to obtain a suitable reforming feedstock. Catalytic processes may employ traditional sulfur-reducing catalyst formulations known to the art including refractory inorganic oxide supports containing metals selected from the group comprising Group VI-B, Group II-B, and Group VIII of the Periodic Table (see Cotton and Wilkinson, *Advanced Inorganic Chemistry*, John Wiley & Sons(Fifth Edition, 1988)). Adsorption processes supplementing or supplanting catalytic pretreatment may employ molecular sieves, high surface area silica-aluminas, carbon molecular sieves, crystalline aluminosilicates, activated carbons, high surface area metallic containing compositions, such as, nickel or copper, and the like.

It is generally preferred to utilize the present invention in a substantially water-free environment. Essential to the achievement of this condition in the reforming zone is the control of the water level present in the charge stock and the hydrogen stream which is being charged to the zone. Best results are ordinarily obtained when the total amount of water entering the conversion zone from any source is held to a level less than 50 ppm (mass parts per million) and preferably less than 20 ppm, expressed as weight of equivalent water in the charge stock. In general, this can be accomplished by careful control of the water present in the charge stock and in the hydrogen stream. The charge stock can be dried by using any suitable drying means known to the art such as a conventional solid adsorbent having a high selectivity for water; for instance, sodium or calcium crystalline aluminosilicates, silica gel, activated alumina, molecular sieves, anhydrous calcium sulfate, high surface area sodium, and the like adsorbents. Similarly, the water content of the charge stock may be adjusted by suitable stripping operations in a fractionation column or like device. In some cases, a combination of adsorbent drying and distillation drying may be used advantageously to effect almost complete removal of water from the charge stock. Preferably, the charge stock is dried to a level corresponding to less than 20 ppm of $H_2O$ equivalent.

Sufficient hydrogen preferably is combined with the feedstock to the present catalyst system to provide a ratio of about 0.1 to 20 moles of hydrogen per mole of hydrocarbon feedstock entering the first reforming zone. More preferably, the ratio is from about 1 to 5 moles of hydrogen per mole of hydrocarbon feed. It is preferred to maintain the water content of a hydrogen stream entering the hydrocarbon conversion zone at a level of about 10 to about 20 volume ppm or less. In the cases where the water content of the hydrogen stream is above this range, the desired water level can be conveniently accomplished by contacting the hydrogen stream with a suitable desiccant such as those mentioned above at conventional drying conditions.

First, intermediate and terminal reforming conditions used in each of the catalyst zones of the present reforming process include a pressure selected within the range of about 100 to 7000 kPa (abs), with the preferred pressure being about 350 kPa to 4250 kPa (abs). Particularly good results are obtained at low pressure, namely a pressure of about 350 to 2500 kPa. The reforming conditions include a temperature in the range from about 315°0 to about 600° C. and preferably from about 425°0 to about 565° C. As is well known to those skilled in the reforming art, the initial selection of the temperature within this range is made primarily as a function of the desired octane of the product reformate considering the characteristics of the charge stock and of the catalyst. Ordinarily, the temperature then is thereafter slowly increased during the run to compensate for the inevitable deactivation that occurs to provide a constant octane product. The liquid hourly space velocity (LHSV) with respect to the total catalyst in all of the catalyst zones is selected within the range of from about 0.1 to about 10 $hr^{-1}$, with a value in the range of about 1 to about 5 $hr^{-1}$ being preferred. To some extent, space velocity and temperature can be exchanged to achieve essentially the same result.

Each of the catalysts required in the process of this invention employs a porous carrier material or support having combined therewith catalytically effective amounts of the required metals and a halogen component. Considering first the refractory support utilized in the present invention, it is preferred that the material be a porous, adsorptive, high-surface area support having a surface area of about 25 to about 500 $m^2/g$. The porous carrier material should also be uniform in composition and relatively refractory to the conditions utilized in the hydrocarbon conversion process. By the term "uniform in composition", it is meant that the support be unlayered, has no concentration gradients of the species inherent to its composition, and is completely homogeneous in composition. Thus, if the support is a mixture of two or more refractory materials, the relative amounts of these materials will be constant and uniform throughout the entire support. It is intended to include within the scope of the present invention carrier materials which have traditionally been utilized in dual-function hydrocarbon conversion catalysts such as: (1) refractory inorganic oxides such as alumina, titania, zirconia, chromia, zinc oxide, magnesia, thoria, boria, silica-alumina, silica-magnesia, chromia-alumina, alumina-boria, silica-zirconia, etc.; (2) ceramics, porcelain, bauxite; (3) silica or silica gel, silicon carbide, clays and silicates including those synthetically prepared and naturally occurring, which may or may not be acid treated, for example attapulgus clay, diatomaceous earth, fuller's earth, kaolin, kieselguhr, etc.; (4) crystalline zeolitic aluminosilicates, naturally occurring or synthetically prepared such as X-zeolite, Y-zeolite, mordenite, β-zeolite, Ω-zeolite, or L-zeolite, either in the hydrogen form or in a form which has been treated with multivalent cations; and (5) combinations of one or more elements from one or more of these groups.

The preferred refractory inorganic oxide for use in the present invention is alumina. Suitable alumina materials are the crystalline aluminas known as the gamma-, eta-, and theta-alumina, with gamma- or eta-alumina giving best results. The preferred refractory inorganic oxide will have an apparent bulk density of about 0.3 to about 1.01 g/cc and surface area characteristics such that the average pore diameter is about 20 to 300 angstroms, the pore volume is about 0.1 to about 1 cc/g, and the surface area is about 100 to about 500 $m^2/g$.

Although alumina is the preferred refractory inorganic oxide, a particularly preferred alumina is that which has been characterized in U.S. Pat. Nos. 3,852,190 and 4,012,313 as a by-product from a Ziegler higher alcohol synthesis reaction as described in Ziegler's U.S. Pat. No. 2,892,858. For purposes of simplification, such an alumina will be hereinafter referred to as a "Ziegler alumina". Ziegler alumina is presently available from the Vista Chemical Company under the trademark "Catapal," from Condea Chemie GMBH under the trademark "Pural," or from ALCOA under the name "HiQ-20." This material is an extremely high purity pseudo-boehmite which, after calcination-at a high temperature, has been shown to yield a high purity gamma-alumina.

The alumina powder can be formed into any desired shape or type of carrier material known to those skilled in the art such as spheres, rods, pills, pellets, tablets, granules, extrudates, and like forms by methods well known to the practitioners of the catalyst material forming art.

A preferred form of the present catalyst support is a sphere, with a preferred diameter of between about 0.7 mm and 3.5 mm. Alumina spheres may be continuously manufactured by the well known oil-drop method which comprises: forming an alumina hydrosol by any of the techniques taught in the art and preferably by reacting aluminum metal with hydrochloric acid; combining the resulting hydrosol with a suitable gelling agent; and dropping the resultant mixture into an oil bath maintained at elevated temperatures. The droplets of the mixture remain in the oil bath until they set and form hydrogel spheres. The spheres are then continuously withdrawn from the oil bath and typically subjected to specific aging and drying treatments in oil and an ammoniacal solution to further improve their physical characteristics. The resulting aged and gelled particles are then washed and dried at a relatively low temperature of about 150° to about 205° C. and subjected to a calcination procedure at a temperature of about 450° to about 700° C. for a period of 5 about 1 to about 20 hours. This treatment effects conversion of the alumina hydrogel to the corresponding crystalline gamma-alumina. U.S. Pat. No. 2,620,314 provides additional details and is incorporated herein by reference thereto.

An alternative form of carrier material is a cylindrical extrudate, preferably prepared by mixing the alumina powder with water and suitable peptizing agents such as HCl until an extrudable dough is formed. The amount of water added to form the dough is typically sufficient to give a loss on ignition (LOI) at 500° C. of about 45 to 65 mass-%, with a value of 55 mass-% being preferred. The acid addition rate is generally sufficient to provide 2 to 7 mass-% of the volatile-free alumina powder used in the mix, with a value of 3 to 4 mass-% being preferred. The resulting dough is extruded through a suitably sized die to form extrudate particles. These particles are then dried at a temperature of about 260° to about 427° C. for a period of about 0.1 to 5 hours to form the extrudate particles. The preferred diameter of cylindrical extrudate particles is between about 0.7 and 3.5 mm, with a length-to-diameter ratio of between about 1:1 and 5:1.

An essential ingredient of the first, intermediate and terminal catalytic composites is a dispersed platinum component. This platinum component may exist within the final catalytic composite as a compound such as an oxide, sulfide, halide, oxyhalide, etc., in chemical combination with one or more of the other ingredients of the composite or as an elemental metal. It is preferred that substantially all of this component is present in the elemental state and is uniformly dispersed within the carrier material. This component may be present in the final catalyst composite in any amount which is catalytically effective, but relatively small amounts are preferred. Platinum generally comprises about 0.01 to about 2 mass % of the final catalytic composite, calculated on an elemental basis. Excellent results are obtained when the catalyst contains about 0.05 to about 1 mass % of platinum.

This platinum component may be incorporated into the catalytic composite in any suitable manner, such as coprecipitation or cogelation, ion-exchange, or impregnation, in order to effect a uniform dispersion of the platinum component within the carrier material. The preferred method of preparing the catalyst involves the utilization of a soluble, decomposable compound of platinum to impregnate the carrier material. For example, this component may be added to the support by commingling the latter with an aqueous solution of chloroplatinic acid. Other water-soluble compounds of platinum may be employed in impregnation solutions and include ammonium chloroplatinate, bromoplatinic acid, platinum dichloride, platinum tetrachloride hydrate, platinum dichlorocarbonyl dichloride, dinitrodiamino-platinum, etc. The utilization of a platinum chloride compound, such as chloroplatinic acid, is preferred since it facilitates the incorporation of both the platinum component and at least a minor quantity of the halogen component in a single step. Best results are obtained in the preferred impregnation step if the platinum compound yields complex anions containing platinum in acidic aqueous solutions. Hydrogen chloride or the like acid is also generally added to the impregnation solution in order to further facilitate the incorporation of the halogen component and the distribution of the metallic component. In addition, it is generally preferred to impregnate the carrier material after it has been calcined in order to minimize the risk of washing away the valuable platinum compounds; however, in some cases, it may be advantageous to impregnate the carrier material when it is in a gelled state.

Rhenium is a preferred metal promoter of the first and terminal catalytic composites. The platinum and rhenium components of the terminal catalytic composite may be composited with the refractory inorganic oxide in any manner which results in a preferably uniform distribution of these components such as coprecipitation, cogelation, coextrusion, ion exchange or impregnation. Alternatively, non-uniform distributions such as surface impregnation are within the scope of the present invention. The preferred method of preparing the catalytic composite involves the utilization of soluble decomposable compounds of platinum and rhenium for impregnation of the refractory inorganic oxide in a relatively uniform manner. For example, the platinum and rhenium components may be added to the refractory inorganic oxide by commingling the latter with an aqueous solution of chloroplatinic acid and thereafter an aqueous solution of perrhenic acid. Other water-soluble compounds or complexes of platinum and rhenium may be employed in the impregnation solutions. Typical platinum compounds include ammonium chloroplatinate, bromoplatinic acid, platinum trichloride, platinum tetrachloride hydrate, platinum dichlorocarbonyl dichloride, dinitrodiaminoplatinum, sodium tetranitroplatinate (II), etc. Decomposable rhenium compounds which may be employed include ammonium perrhenate, sodium perrhenate, potassium perrhenate, potassium rhenium oxychloride, potassium hexachlororhenate (IV), rhenium chloride, rhenium heptoxide, and the like compounds. The utilization of a platinum halogen compound, such as chloroplatinic acid, is preferred since it facilitates the incorporation of both the platinum component and at least a minor quantity of the halogen component in a single step. It is further preferred that an aqueous solution of perrhenic acid be employed in impregnation of the rhenium component.

As heretofore indicated, any procedure may be utilized in compositing the platinum component and rhenium component with the refractory inorganic oxide as long as such method is sufficient to result in relatively uniform distributions of these components. Accordingly, when an impregnation step is employed, the platinum component and rhenium component may be impregnated by use of separate impregnation solutions or, as is preferred, a single impregnation solution comprising decomposable compounds of platinum component and rhenium component. In fact, excellent results are obtained with a one-step impregnation procedure using an aqueous acidic solution containing chloroplatinic acid, perrhenic acid, and hydrochloric acid to impregnate a calcined refractory inorganic oxide comprising alumina. It should be noted that irrespective of whether single or separate impregnation solutions are utilized, hydrogen chloride, nitric acid, or the like acid may be also added to the impregnation solution or solutions in order to further facilitate uniform distribution of the platinum and rhenium components throughout the refractory inorganic oxide. Additionally, it should be indicated that it is generally preferred to impregnate the refractory inorganic oxide after it has been calcined in order to minimize the risk of washing away valuable platinum and rhenium compounds; however, in some cases, it may be advantageous to impregnate refractory inorganic oxide when it is in a gelled, plastic dough or dried state. If two separate impregnations solutions are utilized in order to composite the platinum component and rhenium component with the refractory inorganic oxide, separate oxidation and reduction steps may be employed between application of the separate impregnation solutions. Additionally, halogen adjustment steps may be employed between application of the separate impregnation solutions. Such halogenation steps will facilitate incorporation of the catalytic components and halogen component into the refractory inorganic oxide.

Irrespective of its exact formation, the dispersion of platinum component and rhenium component must be sufficient so that the platinum component comprises, on an elemental basis, from about 0.01 to about 2 mass % of the finished catalytic composite. Additionally, there must be sufficient rhenium component present to comprise, on an elemental basis, from about 0.01 to about 5 mass % of the finished composite.

Indium is an alternative metal promoter of the first and terminal catalytic composites of the present invention. The indium is incorporated into the catalyst composite by a second dispersion of an indium component over the first uniform dispersion of platinum component and rhenium component. It is to be understood that by the phrase "a second dispersion of indium component thereover", it is meant a second application of indium component over the first uniform dispersion of platinum and rhenium component, said second dispersion being formed by contacting the platinum- and rhenium-containing refractory inorganic oxide with indium in a manner which results in a dispersion thereof throughout the refractory inorganic oxide.

At least one oxidation step is required prior to addition of the second dispersion of indium component. The oxidation step acts to assure fixation of the platinum component and rhenium component so that the uniform dispersion thereof is retained, and said oxidation step may be immediately followed by halogen adjustment step. Additionally, a reduction step may be employed either prior to or subsequent to the oxidation step. A reduction step may also follow the halogen adjustment step. Any suitable decomposable indium compound may be utilized to incorporate the indium component into the catalytic composite. Impregnation is a particularly suitable means of contacting the indium with the refractory inorganic oxide. In general, the solvent used in such an impregnation step is selected on the basis of the capability to dissolve the desired indium compound and is preferably an aqueous, acidic solution. Thus, the indium component may be added to the refractory inorganic oxide by commingling the latter with an aqueous, acidic solution of suitable indium salt or suitable compound of indium such as indium tribromide, indium perchlorate, indium trichloride, indium trifluoride, indium nitrate, indium sulfate, and the like compounds. A particularly preferred impregnation solution comprises an acidic solution of indium trichloride in water. Following impregnation of the second dispersion of indium component, the resulting composite may then be subjected to an oxidation step followed by a halogen adjustment step and subsequent reduction step. Irrespective of the exact method of forming the second dispersion, sufficient (rhenium+indium) components should be contained therein to comprise, on an elemental basis, from about 0.01 to about 5 mass % of the finished composite.

An alternative metal promoter of the first and terminal catalytic composite of the present invention is a tin component. This component may be present as an elemental metal, as a chemical compound such as the oxide, sulfide, halide, oxychloride, etc., or as a physical or chemical combination with the porous carrier material and/or other components of the catalytic composite. The tin component is preferably utilized in an amount sufficient to result in a final catalytic composite containing about 0.01 to about 5 mass % tin, calculated on an elemental basis, with best results obtained at a level of about 0.1 to about 2 mass %. The tin component may be incorporated in the catalytic composite in any suitable manner to achieve a uniform dispersion such as by coprecipitation or cogelation with the porous carrier material, ion-exchange with the carrier material or impregnation of the carrier material at any stage in the preparation. It is to be noted that it is intended to include within the scope of the present invention all conventional methods for incorporating a tin component in a catalytic composite. One preferred method of incorporating the tin component into the catalytic composite involves coprecipitating the tin component during the preparation of the preferred refractory oxide carrier material. In the preferred case, this involves the addition of suitable soluble tin compounds such as stannous or stannic halide to the alumina hydrosol, and then combining the hydrosol with a suitable gelling agent and dropping the resulting mixture into an oil bath, etc., as explained in detail hereinbefore. Following the calcination step there is obtained a carrier material having a uniform dispersion of stannic oxide in an intimate combination with alumina. Another preferred method of incorporating the tin component into the catalyst composite involves the utilization of a soluble, decomposable compound of tin to impregnate and uniformly disperse the tin throughout the porous carrier material.

Thus, the tin component may be added to the carrier material by commingling the latter with an aqueous solution of a suitable tin salt or water-soluble compound of tin such as stannous bromide, stannous chloride, stannic chloride, stannic chloride pentahydrate, stannic chloride tetrahydrate, stannic chloride trihydrate, stannic chloride diamine, stannic trichloride bromide, stannic chromate, stannous fluoride, stannic fluoride, stannic iodide, stannic sulfate, stannic tartrate, and the like compounds. The utilization of a tin chloride compound, such as stannous or stannic chloride is particularly preferred since it facilitates the incorporation of both the tin component and at least a minor amount of the essential halogen component in a single step. In general, the tin component can be impregnated either prior to, simultaneously with, or after the other components are added to the carrier material.

It is contemplated in the present invention that one or both of the first and terminal catalytic composite may contain other metallic modifiers in addition to or instead of the aforementioned rhenium, indium, tin, rhodium, ruthenium, cobalt, nickel, and iridium. Such modifiers are known to those or ordinary skill in the art and include but are not limited to cerium, gallium, and thallium. Catalytically effective amounts of such modifiers may be incorporated into the catalyst composite in any suitable manner known to the art.

In an alternative embodiment, one or both of the first and terminal catalytic composites has an essential absence of germanium, characterized as less than about 0.05 mass % germanium on an elemental basis.

Alternatively, the metal promoter of the first or terminal catalytic composite of the present invention is a surface-impregnated metal component selected from the group consisting of platinum, rhodium, ruthenium, cobalt, nickel, iridium, and mixtures thereof. It is to be understood that as utilized herein, the term "surface-impregnated" means that at least 80% of the surface-impregnated component is located within the exterior surface of the catalyst particle. The term "exterior surface" is defined as the outermost layer of the catalyst, preferably that which comprises the exterior 50% of the catalyst volume. By "layer" is meant a stratum of substantially uniform thickness.

A metal component is considered surface-impregnated when the average concentration of said metal component within the exterior surface of the catalyst is at least 4 times the average concentration of the same metal component in the remaining interior portion of the catalyst. Alternatively, a metal component is said to be surface-impregnated when the average atomic ratio of the metal component to the uniformly dispersed platinum component is at least 4 times greater in magnitude within the exterior surface of the catalyst than it is within the remaining interior portion. A catalytic composite comprising a surface-impregnated metal component is described in U.S. Pat. No. 4,677,094, which is incorporated by reference into this specification.

A surface-impregnated metal component may be present in the composite as an elemental metal or in chemical combination with one or more of the other ingredients of the composite, or as a chemical compound of the metal such as the oxide, oxyhalide, sulfide, halide, and the like. The metal component may be utilized in the composite in any amount which is catalytically effective, with the preferred amount being about 0.01 to about 2 mass % thereof, calculated on an elemental metal basis. Typically, best results are obtained with about 0.05 to about 1 mass % of surface-impregnated metal. Additionally, it is within the scope of the present invention that beneficial results may be obtained by having more than one of the above-named metals surface-impregnated on the catalyst.

A surface-impregnated metal component may be incorporated into the catalytic composite in any suitable manner which results in the metal component being concentrated in the exterior surface of the catalyst support in the preferred manner. In addition, it may be added at any stage of the preparation of the composite—either during preparation of the carrier material or thereafter—and the precise method of incorporation used is not deemed to be critical so long as the resulting metal component is surface-impregnated as the term is used herein. A preferred way of incorporating this component is an impregnation step wherein the porous carrier material containing uniformly dispersed platinum is impregnated with a suitable metal-containing aqueous solution. It is also preferred that no "additional" acid compounds are to be added to the impregnation solution. In a particularly preferred method of preparation the carrier material containing platinum is subjected to oxidation and halogen stripping procedures, as is explained hereinafter, prior to the impregnation of the surface-impregnated metal components. Aqueous solutions of water soluble, decomposable surface-impregnated metal compounds are preferred, including hexaminerhodium chloride, rhodium carbonylchloride, rhodium trichloride hydrate, ammonium pentachloroaquoruthenate, ruthenium trichloride, nickel chloride, nickel nitrate, cobaltous chloride, cobaltous nitrate, iridium trichloride, iridium tetrachloride and the like compounds.

An essential constituent of the intermediate catalytic composite is a germanium component. This component may in general be present in the composite in any catalytically available form such as the elemental metal, a compound such as the oxide, hydroxide, halide, oxyhalide, aluminate, or in chemical combination with one or more of the other ingredients of the catalyst. Although it is not intended to restrict the present invention by this explanation, it is believed that best results are obtained when the germanium component is present in the composite in a form wherein substantially all of the germanium moiety is in an oxidation state above that of the elemental metal such as in the form of germanium oxide or germanium oxyhalide or germanium halide or in a mixture thereof and the subsequently described oxidation and reduction steps that are preferably used in the preparation of the instant catalytic composite are specifically designed to achieve this end. The term "germanium oxyhalide" as used herein refers to a coordinated complex of germanium, oxygen, and halogen which are not necessarily present in the same relationship for all cases covered herein.

This germanium component can be used in any amount which is catalytically effective, with good results obtained, on an elemental basis, with about 0.05, to about 5 mass % germanium in the catalyst. Best results are ordinarily achieved with about 0.01 to about 1 mass % germanium, calculated on an elemental basis. The preferred atomic ratio of germanium to platinum group metal for this catalyst is about 0.1:1 to about 20:1.

The germanium component is preferably incorporated in the catalytic composite in any suitable manner known to the art to result in a relatively uniform dispersion of the germanium moiety in the carrier material, such as by coprecipitation or cogelation, or coextrusion with the porous carrier material, ion exchange with the gelled carrier material, or impregnation of the porous carrier material either after, before, or during the period when it is dried and calcined. Methods which result in non-uniform germanium distribution are within the scope of the present invention. It is intended to include within the scope of the present invention all conventional methods for incorporating and simultaneously distributing a metallic component in a catalytic composite in a desired manner, and the particular method of incorporation used is not deemed to be an essential feature of the present invention. One method of incorporating the germanium component into the catalytic composite involves cogelling or coprecipitating the germanium component in the form of the corresponding hydrous oxide or oxyhalide during the preparation of the preferred carrier material, alumina. This method typically involves the addition of a suitable sol-soluble or sol-dispersible germanium compound such as germanium tetrachloride, germanium oxide, and the like to the alumina hydrosol and then combining the germanium-containing hydrosol with a suitable gelling agent and dropping the resulting mixture into an oil bath, etc., as explained in detail hereinbefore. Alternatively, the germanium compound can be added to the gelling agent. After drying and calcining the resulting gelled carrier material in air, there is obtained an intimate combination of alumina and germanium oxide and/or oxychloride. One preferred method of incorporating the germanium component into the catalytic composite involves utilization of a soluble, decomposable compound of germanium to impregnate the porous carrier material. In general, the solvent used in this impregnation step is selected on the basis of the, capability to dissolve the desired germanium compound and to hold it in solution until it is evenly distributed throughout the carrier material without adversely affecting the carrier material or the other ingredients of the catalyst—for example, a suitable alcohol, ether, acid, and the like solvents. One preferred solvent is an aqueous, acidic solution. Thus, the germanium component may be added to the carrier material by commingling the latter with an aqueous acidic solution of suitable germanium salt, complex, or compound such as germanium oxide, germanium tetrachloride, germanium tetraethoxide, germanium difluoride, germanium tetrafluoride, germanium di-iodide, ethylgermanium oxide, tetraethylgermanium, and the like compounds. A particularly preferred impregnation solution comprises an anhydrous alcoholic solution of germanium tetrachloride, germanium trifluoride chloride, germanium dichloride difluoride, ethyltriphenylgermanium, tetramethylgermanium, and the like compounds. Suitable acids for use in the impregnation solution are: inorganic acids such as hydrochloric acid, nitric acid, and the like, and strongly acidic organic acids such as oxalic acid, malonic acid, citric acid, and the like. In general, the germanium component can be impregnated either prior to, simultaneously with, or after the platinum group component is added to the carrier material. However, excellent results are obtained when the germanium component is impregnated simultaneously with the platinum group component.

In alternative embodiments, the intermediate catalytic composite comprises platinum, rhenium, and germanium. In these alternative embodiments, platinum and germanium components are incorporated into the carrier material as described hereinabove. Prior to incorporation of the rhenium component, the platinum and germanium-containing composite may be oxidized at from about 370° C. to about 600° C. as described hereinafter in more detail. Distilled water preferably is injected into the air stream in the oxidation step to adjust the halogen content of the composite. The halogen-content of the platinum- and germanium-containing composite should be from about 0.1 to about 10 mass % before addition of the rhenium component, with the preferred range being from about 0.1 to about 1.0 mass % halogen. The rhenium component preferably is incorporated into the catalytic composite utilizing a soluble, decomposable rhenium compound. Rhenium compounds which may be employed include ammonium perrhenate, sodium perrhenate, potassium perrhenate, potassium rhenium oxychloride, potassium hexachlororhenate (IV), rhenium chloride, rhenium heptoxide, and the like compounds. Best results are obtained when an aqueous solution,of perrhenic acid is employed in impregnation of the rhenium component.

Optionally, the intermediate catalytic composite has an essential absence of metal promoters other than germanium, characterized as less than about 0.05 mass % of such promoters on an elemental basis. In this embodiment, the intermediate catalytic composite consists essentially of a platinum-group metal component, a germanium component, a refractory inorganic oxide and a halogen component.

As heretofore indicated, it is necessary to employ at least one oxidation step in the preparation of the catalytic composites of the invention. The conditions employed to effect the oxidation step are selected to convert substantially all of the metallic components within the catalytic composite to their corresponding oxide form. The oxidation step typically takes place at a temperature of from about 370° to about 600° C. An oxygen atmosphere is employed typically comprising air. Generally, the oxidation step will be carried out for a period of from about 0.5 to about 10 hours or more, the exact period of time being that required to convert substantially all of the metallic components to their corresponding oxide form. This time will, of course, vary with the oxidation temperature employed and the oxygen content of the atmosphere employed.

In addition to the oxidation step, a halogen adjustment step may also be employed in preparing the catalyst. As heretofore indicated, the halogen adjustment step may serve a dual function. First, the halogen adjustment step aids in formation of the first or second dispersion of a metal promoter. Additionally, since the catalyst of the instant invention comprises a halogen component, the halogen adjustment step can serve as a means of incorporating the desired level of halogen into the final catalytic composite. The halogen adjustment step employs a halogen or halogen-containing compound in air or an oxygen atmosphere. Since the preferred halogen for incorporation into the catalytic composite comprises chlorine, the preferred halogen or halogen-containing compound utilized during the halogen adjustment step is chlorine, HCl, or precursor of these compounds. In carrying out the halogen adjustment step, the catalytic composite is contacted with the halogen or halogen-containing compound in air or an oxygen atmosphere at an elevated temperature of from about 370° to about 600° C. It is further desired to have water present during the contacting step in order to aid in the adjustment. In particular, when the halogen component of the catalyst comprises chlorine, it is preferred to use a mole ratio of water to HCl of about 5:1 to about 100:1. The duration of the halogenation step is typically from about 0.5 to about 5 hours or more. Because of the similarity of conditions, the halogen adjustment step may take place during the oxidation step. Alternatively, the halogen adjustment step may be performed before or after the oxidation step as required by the particular method being employed to prepare the catalyst of the invention. Irrespective of the exact halogen adjustment step employed, the halogen content of the final catalyst should be such that there is sufficient halogen to comprise, on an elemental basis, from about 0.1 to about 10 mass % of the finished composite.

In an alternative embodiment, the halogen content of the intermediate catalytic composite is lower than that of the terminal catalytic composite. Higher $C_5^+$ product selectivity results when the chlorine-component content of catalysts of the present invention are adjusted in this manner. The halogen content of each catalyst may be adjusted in any suitable manner as described hereinabove.

In preparing the catalyst, it is also necessary to employ a reduction step. The reduction step is designed to reduce substantially all of the platinum component, and preferably also the metal promoter to the corresponding elemental metallic states and to ensure a relatively uniform and finely divided dispersion of these components throughout the refractory inorganic oxide. It is preferred that the reduction step take place in a substantially water-free environment. Preferably, the reducing gas is substantially pure, dry hydrogen (i.e., less than 20 volume ppm water). However, other reducing gases may be employed such as $CO_2$, nitrogen, etc. Typically, the reducing gas is contacted with the oxidized catalytic composite at conditions including a reduction temperature of from about 315° to about 650° C. for a period of time of from about 0.5 to 10 or more hours effective to reduce substantially all of the platinum component and any rhenium component to the elemental metallic state. The reduction step may be performed prior to loading the catalytic composite into the hydrocarbon conversion zone or it may be performed in situ as part of a hydrocarbon conversion process start-up procedure. However, if this latter technique is employed, proper precautions must be taken to predry the hydrocarbon conversion plant to a substantially water-free state and a substantially water-free hydrogen-containing reduction gas should be employed.

One or both of the first and terminal catalytic composites may be beneficially subjected to a presulfiding step designed to incorporate sufficient sulfur to comprise, on an elemental basis, from about 0.05 to about 0.5 mass % of the finished composite. The sulfur component may be incorporated into the catalyst by any known technique. For example, the catalytic composite may be subjected to a treatment which takes place in the presence of hydrogen in a suitable sulfur-containing compound such as hydrogen sulfide, lower molecular weight mercaptans, organic sulfides, disulfides, etc. Typically, this procedure comprises treating the reduced catalyst with a sulfiding gas such as a mixture of hydrogen and hydrogen sulfide having about 10 moles of hydrogen per mole of hydrogen sulfide at conditions sufficient to effect the desired incorporation of sulfur, generally including a temperature ranging from about 10° up to about 600° C. or more. It is generally a good practice to perform this sulfiding step under substantially water-free conditions.

EXAMPLES

The following examples show the advantages of alternative embodiments of the invention, and also provide data for the drawings summarized hereinabove. The examples illustrate the invention without limiting the scope thereof.

Example I

A reforming kinetic model was developed from pilot-plant and commercial reforming data which represented a substantial advance over previous models. This model reflects 36 components and 46 reactions. The reactions cover cracking, dehydrocyclization, dehydrogenation and isomerization. In parameter fitting from commercial data, the dehydrogenation rate was adjusted to match the heat-of-reaction distribution.

Models were developed for the performance of each of the catalysts characterized hereinbelow.

Example II

A four-reactor reforming system was modeled according to Example I. The four reactors contained respectively 10%, 15%, 25% and 50% of the catalyst. Catalyst zones were established using two catalysts: "Catalyst A" was chlorided platinum-germanium on an extruded alumina support, and "Catalyst B" was a platinum-rhenium catalyst on a spherical oil-dropped substrate as described hereinabove. The key parameters of catalyst composition were (mass %):

| | Catalyst A | Catalyst B |
|---|---|---|
| Pt | 0.376% | 0.25% |
| Ge | 0.250% | — |
| Re | — | 0.25% |
| Cl | 1.05% | 1.0% |

The same feedstock was used for all comparative test, and had the following characterisics:

| | |
|---|---|
| Sp. Gr. | 0.744 |
| ASTM D-86, °C.: | |
| IBP | 80 |
| 50% | 147 |
| EP | 204 |
| Volume %: | |
| paraffins | 69.1 |
| naphthenes | 20.8 |
| aromatics | 10.1 |

The tests all were based on producing a 98 RON (Research Octane Number) clear $C_5^+$ product at 1725 kPa (ga) pressure. The objective was to consider the proportional reduction in the relatively expensive Catalyst A, based on the multizone reforming of the invention. Results were as follows, expressed as the order of catalysts in each reactor:

| Catalyst: | $C_5$+, Mass-% | $H_2$, Mass-% | * |
|---|---|---|---|
| AAAB (art) | 80.3 | 1.96 | base |
| BAAB (invention) | 80.1 | 1.95 | 20 |
| BBAB (invention) | 79.4 | 1.89 | 50 |
| BBBB (art) | 78.6 | 1.81 | 100 |

* Percent reduction in expensive catalyst A.

The comparative results also are shown in FIG. 1. The data show that the multi-zone catalysts provided surprisingly favorable yields for the degree of reduction effected in the proportion of expensive Catalyst A.

Example Ill three-reactor reforming system was modeled according to Example I. The three reactors contained respectively 20%, 30% and 50% of the catalyst. Catalyst zones were established using the same two catalysts as in Example II. The feedstock and operating conditions also were the same as in Example II.

Once again, the objective was to consider the proportional reduction in the relatively expensive Catalyst A, based on the multizone reforming of the invention. Results were as follows, expressed as the order of catalysts in each reactor:

| Catalyst: | $C_5$+, Mass-% | $H_2$, Mass-% | * |
|---|---|---|---|
| AAB (art) | 80.1 | 1.93 | base |
| BAB (invention) | 79.8 | 1.91 | 40 |
| BBB (art) | 78.7 | 1.81 | 100 |

* Percent reduction in expensive catalyst A.

The comparative results also are shown in FIG. 2. The data show that the multi-zone catalysts provided surprisingly favorable yields for the degree of reduction effected in the proportion of expensive Catalyst A.

We claim:

1. A process for the catalytic reforming of hydrocarbons comprising contacting a hydrocarbon feedstock in a catalyst system which comprises at least three sequential catalyst zones to obtain a reformate, comprising the steps of:

(a) contacting the feedstock with a first catalytic composite consisting essentially of a platinum-group metal component, a metal promoter selected from the group consisting of rhenium, indium and tin, a refractory inorganic oxide, and a halogen component in an first catalyst zone at first reforming conditions to obtain a first effluent;

(b) contacting the first effluent with an intermediate catalytic composite consisting essentially of a platinum-group metal component, a germanium component, a refractory inorganic oxide, and a halogen component in an intermediate catalyst zone at intermediate reforming conditions to obtain an intermediate effluent; and, (c) contacting the intermediate effluent with a terminal catalytic composite consisting essentially of a platinum-group metal component, a metal promoter selected from the group consisting of rhenium, indium and tin, a refractory inorganic oxide, and a halogen component in a terminal catalyst zone at terminal reforming conditions to obtain a reformate.

2. The process of claim 1 wherein each of the first, intermediate and terminal reforming conditions comprise a pressure of about 350 to 2500 kPa (ga), a temperature of about 425° to 565° C., and a liquid hourly space velocity of about 0.1to 10hr.

3. The process of claim 1 wherein hydrogen is combined with the feedstock to the present catalyst system to provide a ratio of about 0.1 to 20 moles of hydrogen per mole of hydrocarbon feedstock entering the first catalyst zone.

4. The process of claim 1 wherein the refractory inorganic oxide of each of the first, intermediate and terminal catalytic composites comprises alumina.

5. The process of claim 1 wherein each of the first, intermediate and terminal catalytic composites contains from about 0.01 to about 2 mass % on an elemental basis of the platinum-group metal.

6. The process of claim 5 wherein the platinum-group metal of one or more of the first, intermediate and terminal catalytic composites comprises platinum.

7. The process of claim 1 wherein the metal promoter of one or both of the first and terminal catalytic composites is selected from at least one of the group consisting of rhenium, cobalt, nickel, indium, tin, rhodium, ruthenium, iridium, and mixtures thereof.

8. The process of claim 7 wherein the metal promoter of each of the first and the terminal catalytic composites comprises one or both of rhenium and indium, and each of the first and the terminal catalytic composites contains from about 0.01 to about 5 mass % on an elemental basis of metal promoter.

9. The process of claim 1 wherein the intermediate catalytic composite contains from about 0.05 to about 5 mass % germanium on an elemental basis.

10. The process of claim 1 wherein one or both of the first and terminal catalytic composites contains less than about 0.05 mass % germanium on an elemental basis.

11. The process of claim 1 wherein the intermediate catalytic composite consists essentially of a platinum-group metal component, a germanium component, a refractory inorganic oxide, and a halogen component.

12. The process of claim 1 wherein each of the first, intermediate and terminal catalytic composites contains from about 0.1 to about 10 mass % halogen on an elemental basis.

13. The process of claim 12 wherein the halogen component of each of the catalytic composites comprises a chlorine component.

14. The process of claim 1 wherein one or both of the first and terminal catalytic composites comprises a sur component.

15. The process of claim 1 wherein the first and intermediate catalyst zones comprise fixed beds and the terminal catalyst zone is a moving-bed system with associated continuous catalyst regeneration.

16. The process of claim 1 wherein the first catalytic composite comprises from about 10% to about 50%, the intermediate catalytic composite comprises from about 20% to about 60% and the terminal catalytic composite comprises from about 30% to about 70% of the total mass of catalytic composites in all of the catalyst zones.

17. A process for the catalytic reforming of hydrocarbons comprising contacting a hydrocarbon feedstock in a catalyst system which comprises at least three sequential catalyst zones to obtain a reformate, comprising the steps of:

(a) contacting the feedstock with a first catalytic composite consisting essentially of a platinum-group metal component, a metal promoter selected from the group consisting of rhenium, indium and tin, a refractory inorganic oxide, and a halogen component in an first catalyst zone at first reforming conditions to obtain a first effluent;

(b) contacting the first effluent with an intermediate catalytic composite consisting essentially of a platinum-group metal component, a germanium component, a refractory inorganic oxide, and a halogen component in an intermediate catalyst zone at intermediate reforming conditions to obtain an intermediate effluent; and, (c) contacting the intermediate effluent with a terminal catalytic composite consisting essentially of a platinum-group metal component, a metal promoter selected from the group consisting of rhenium, indium and tin, a refractory inorganic oxide, and a halogen component in a terminal catalyst zone comprising a moving-bed system with continuous catalyst regeneration at terminal reforming conditions to obtain a reformate.

18. The process of claim 19 wherein wherein hydrogen is combined with the feedstock to the present catalyst system to provide a ratio of about 0.1 to 20 moles of hydrogen per mole of hydrocarbon feedstock entering the first catalyst zone.

* * * * *